US007886733B2

(12) United States Patent
Holmberg

(10) Patent No.: US 7,886,733 B2
(45) Date of Patent: Feb. 15, 2011

(54) METHOD OF MOUNTING AN AUTONOMOUS ELECTRONIC DEVICE ON TO A CROSSBOW

(76) Inventor: Larry Holmberg, P.O. Box 176, Harrisburg, SD (US) 57032

( * ) Notice: Subject to any disclaimer, the term of this patent is extended or adjusted under 35 U.S.C. 154(b) by 32 days.

(21) Appl. No.: 12/383,418

(22) Filed: Mar. 23, 2009

(65) Prior Publication Data

US 2009/0183353 A1 Jul. 23, 2009

Related U.S. Application Data

(63) Continuation of application No. 11/479,610, filed on Jun. 30, 2006, now Pat. No. 7,506,643.

(51) Int. Cl.
*F41B 5/12* (2006.01)
*F41B 5/00* (2006.01)

(52) U.S. Cl. ..... 124/86; 124/25; 124/87; 33/265

(58) Field of Classification Search ..... 33/265; 124/23.1, 25, 86, 87
See application file for complete search history.

(56) References Cited

U.S. PATENT DOCUMENTS

| | | | |
|---|---|---|---|
| 3,065,666 | A | 11/1962 | Sampson |
| 3,427,102 | A | 2/1969 | Wade |
| 3,483,623 | A | 12/1969 | Kruzell |
| 3,737,232 | A | 6/1973 | Milburn, Jr. |
| 3,782,822 | A | 1/1974 | Spence |
| 3,834,052 | A | 9/1974 | Steck, III |
| 4,026,054 | A | 5/1977 | Snyder |
| 4,027,414 | A | 6/1977 | Felix |
| 4,516,296 | A | 5/1985 | Sherman |
| 4,786,204 | A | 11/1988 | Mayeda |
| 4,835,621 | A | 5/1989 | Black |
| 4,890,128 | A | 12/1989 | Kania |
| 4,907,567 | A | 3/1990 | Henrich |
| 4,939,863 | A | 7/1990 | Alexander et al. |
| 5,020,262 | A | 6/1991 | Pena |
| 5,026,158 | A | 6/1991 | Golubic |
| 5,606,818 | A | 3/1997 | Hardee |
| 5,887,375 | A | 3/1999 | Watson |
| 6,192,614 | B1 | 2/2001 | Cliburn |
| 6,286,796 | B1 | 9/2001 | Pugliesi |

(Continued)

FOREIGN PATENT DOCUMENTS

EP 1804017 A1 7/2007

(Continued)

OTHER PUBLICATIONS

Improved Construction Methods, "Laser Measuring System, Impulse LX", http://www.improvedconstructionmethods.com/impulse_xl.htm.

(Continued)

*Primary Examiner*—John Ricci
(74) *Attorney, Agent, or Firm*—Kinney & Lange, P.A.

(57) ABSTRACT

A method of mounting an autonomous electronic device onto a crossbow including the steps of attaching a scope mount ring to a scope on the crossbow; attaching a device mount to the scope mount ring; and securing an autonomous electronic device selected from a video camera and a range finder to the device mount.

10 Claims, 5 Drawing Sheets

U.S. PATENT DOCUMENTS

| | | | |
|---|---|---|---|
| 6,336,285 | B1 | 1/2002 | Baumer |
| 6,425,697 | B1 | 7/2002 | Potts et al. |
| 2002/0109057 | A1 | 8/2002 | Wooten et al. |
| 2004/0000083 | A1 | 1/2004 | Grant, Jr. |
| 2004/0257437 | A1 | 12/2004 | Lesseu |
| 2005/0268519 | A1 | 12/2005 | Pikielny |
| 2007/0157502 | A1 | 7/2007 | Holmberg |
| 2007/0157503 | A1 | 7/2007 | Holmberg |
| 2008/0000465 | A1 | 1/2008 | Holmberg |

FOREIGN PATENT DOCUMENTS

| | | | |
|---|---|---|---|
| GB | 2024558 | A | 1/1980 |
| GB | 2114770 | A | 8/1983 |
| WO | WO9012330 | | 10/1990 |
| WO | WO2006090356 | A1 | 8/2006 |
| WO | WO2006133029 | A2 | 12/2006 |

OTHER PUBLICATIONS

"Specification Sheet on the Impulse 200 LR Laser (Rangefinder)," 11/15/03, Publisher: Laser Technology Inc.

METHOD OF MOUNTING AN AUTONOMOUS ELECTRONIC DEVICE ON TO A CROSSBOW

This is a continuation of U.S. patent application Ser. No. 11/479,610 filed Jun. 30, 2006.

BACKGROUND

For game hunters the ability to record the hunt in an efficient manner is desired. Moreover, the ability to attach other devices such as rangefinders and other electronic devices to the weapon in a manner that does not impede the hunt is also desired. For the reasons stated above and for other reasons stated below which will become apparent to those skilled in the art upon reading and understanding the present specification, there is a need in the art for a mount that can attach a device such an electronic device to a crossbow in an effective and un-intrusive manner.

SUMMARY OF INVENTION

The above-mentioned problems of current systems are addressed by embodiments of the present invention and will be understood by reading and studying the following specification. The following summaries are provided as way of examples and not by way of limitations. Moreover, the summaries may include more or less elements than are in the claims and are merely provided to give the reader a basic understanding of some of the elements of the present invention.

In one embodiment, a crossbow device mount system is provided. The mount system includes a device mount. The device mount has a support portion and a side portion. The support portion is adapted to be coupled to a device. The side portion is adapted to be coupled to a scope on a crossbow.

In another embodiment, another crossbow device mount system is provided, the mount system includes a device mount and a scope ring. The device mount has a support plate adapted to support a device resting thereon. The support plate has a plurality of apertures passing there through. The support plate further has a side plate. The side plate has a mounting rail extending there from. The scope mount ring is adapted to engage the mounting rail. The scope mount ring is further adapted to be coupled to a scope that is mounted on a crossbow.

In yet another embodiment, a method of mounting a device on a crossbow is provided. The method includes attaching a device mount to a scope mounted on the crossbow and securing a device to the device mount.

BRIEF DESCRIPTION OF THE DRAWINGS

The present invention can be more easily understood and further advantages and uses thereof more readily apparent, when considered in view of the description of the preferred embodiments and the following figures in which.

In accordance with common practice, the various described features are not drawn to scale but are drawn to emphasize specific features relevant to the present invention. Reference characters denote like elements throughout Figures and text.

DETAILED DESCRIPTION

In the following detailed description, reference is made to the accompanying drawings, which form a part hereof, and in which is shown by way of illustration specific embodiments in which the inventions may be practiced. These embodiments are described in sufficient detail to enable those skilled in the art to practice the invention, and it is to be understood that other embodiments may be utilized and that logical, mechanical and electrical changes may be made without departing from the spirit and scope of the present invention. The following detailed description is, therefore, not to be taken in a limiting sense, and the scope of the present invention is defined only by the claims and equivalents thereof.

Embodiments of the present invention provide a method and system of mounting a device to a crossbow that will not hamper the hunt and is easy to accomplish. In embodiments, a device mount is designed to mount to a scope on the crossbow. A device, such as a video camera, range finder, game caller or the like, is attached to the device mount.

Figure 1:
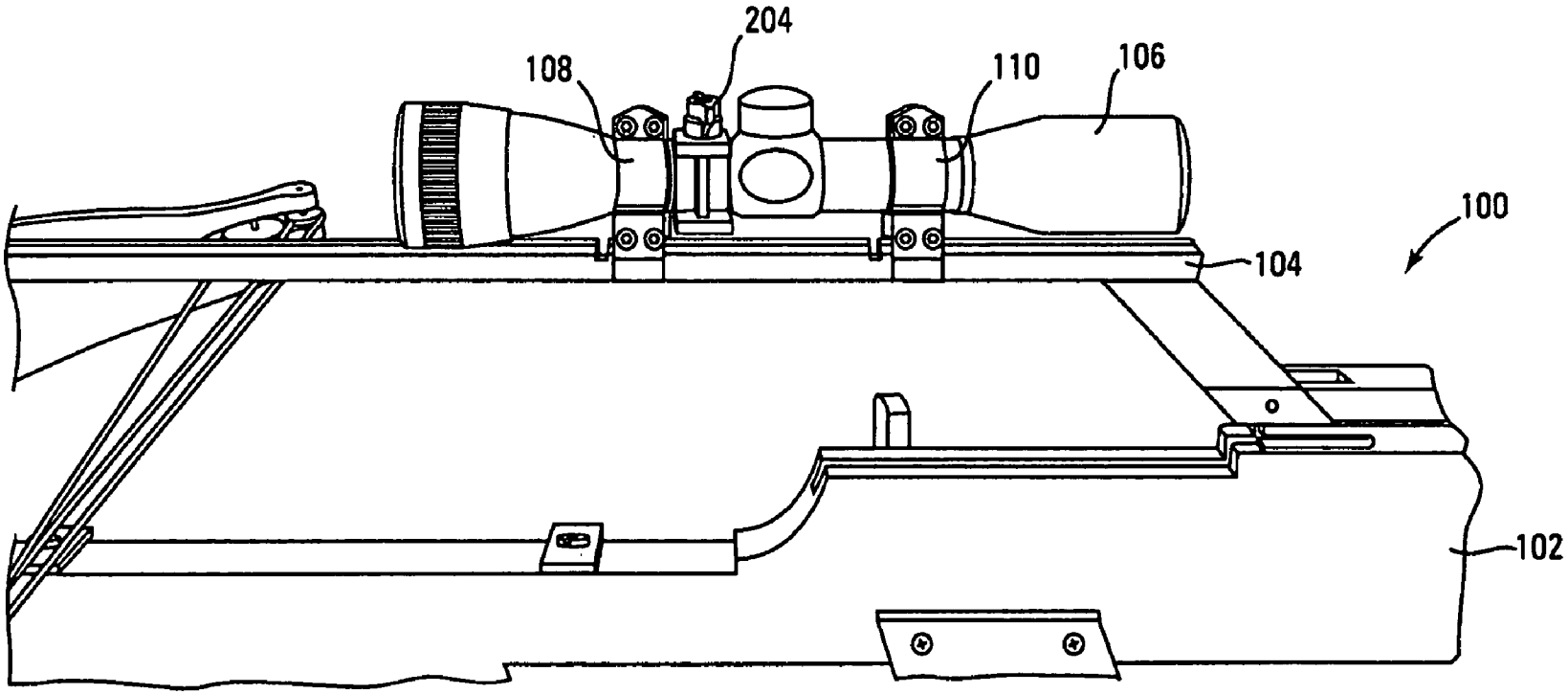
FIG. 1 is a side view of a partial crossbow having a scope mounted thereon and a scope mount ring coupled to the scope to secure a device mount of one embodiment of the present invention.

Referring to FIG. 1, a side view of a crossbow 100 with a scope 106 mounted thereon is illustrated. As illustrated, the crossbow 100 includes a main frame 102 and a rail 104. The scope 106 is mounted to the rail 104 via scope mount rings 108 and 110. Also illustrated in FIG. 1, is a scope mount ring (or scope mount) 204 that is used in at least some embodiments of the present invention to mount a device mount to the scope.

Figure 2:
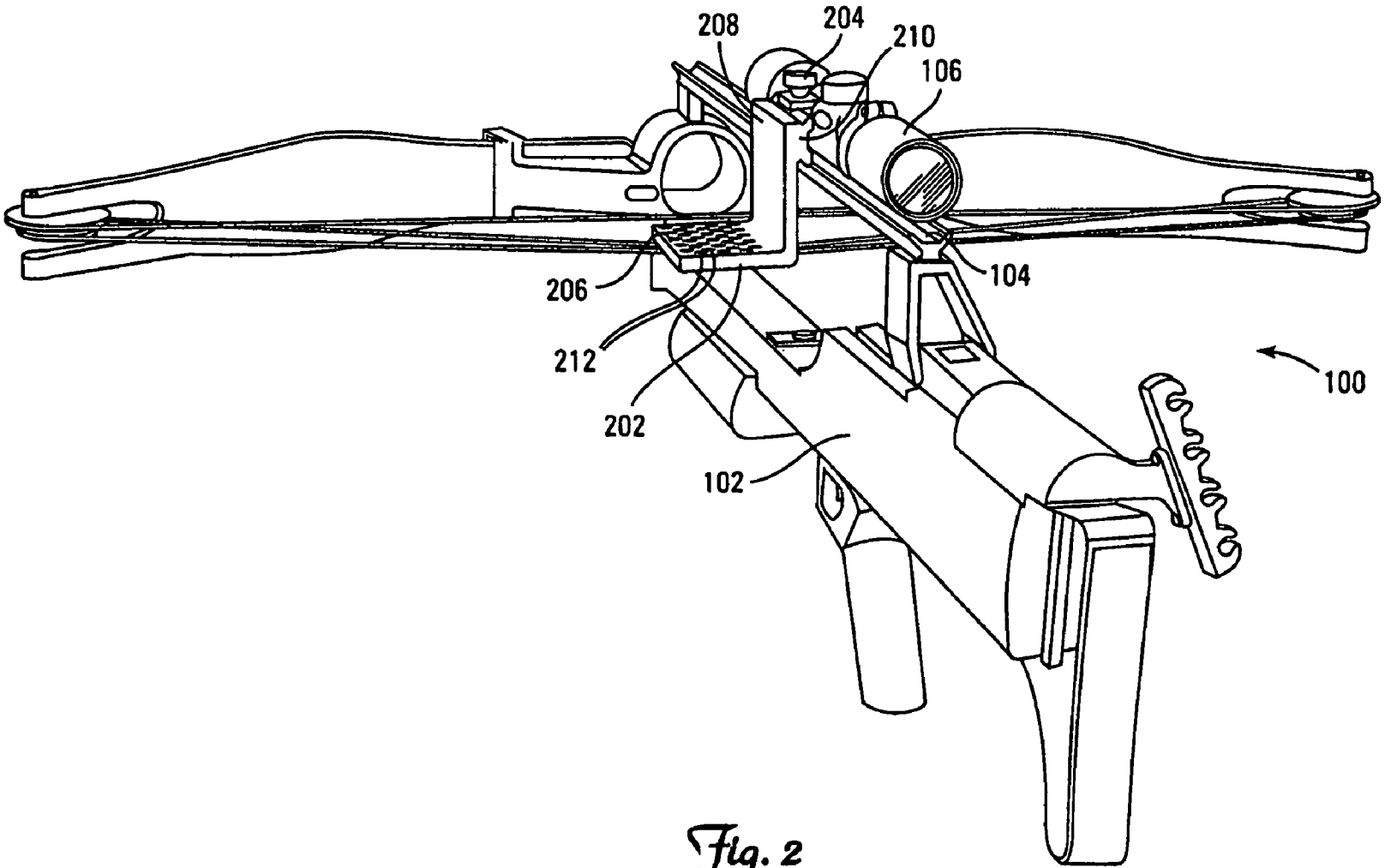
FIG. 2 is a back perspective view of a crossbow including a device mount of one embodiment of the present invention.
Figure 3:
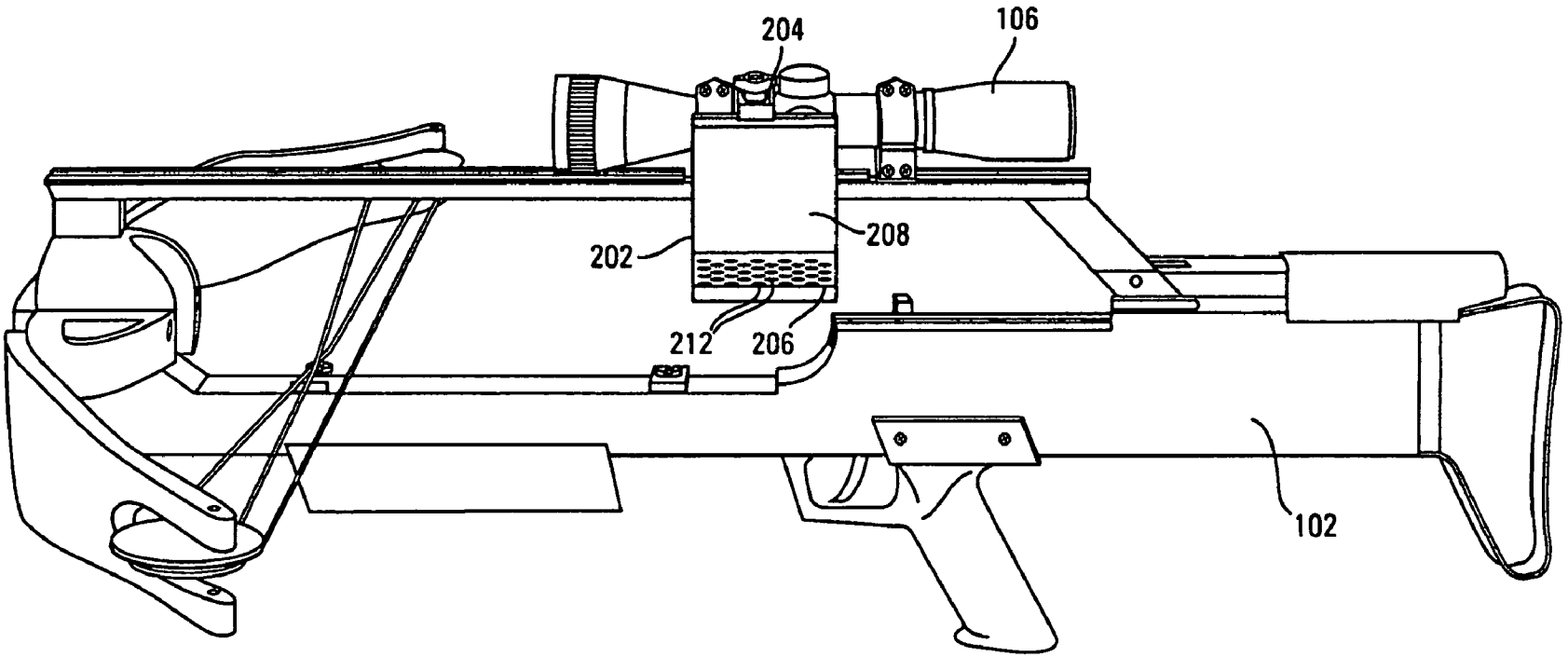
FIG. 3 is a side perspective view of a crossbow including a device mount of one embodiment of the present invention.

Referring to FIG. 2, a back perspective view of the crossbow 100 having a device mount 202 mounted to the scope 106 of one embodiment is illustrated. As illustrated, the device mount 202 includes a support portion or plate 206 and a side portion or plate 208. The support portion 206 has a plurality of mounting apertures 212 passing there through. Also illustrated is a scope mount ring 204 that mounts the device mount 202 to the scope 106. In particular, the scope mount ring 204 is attached to a mounting rail 210 of the device mount 202 as illustrated. FIG. 3 illustrates a side perspective view of the device mount 202 coupled to the scope 106.

Figure 4:
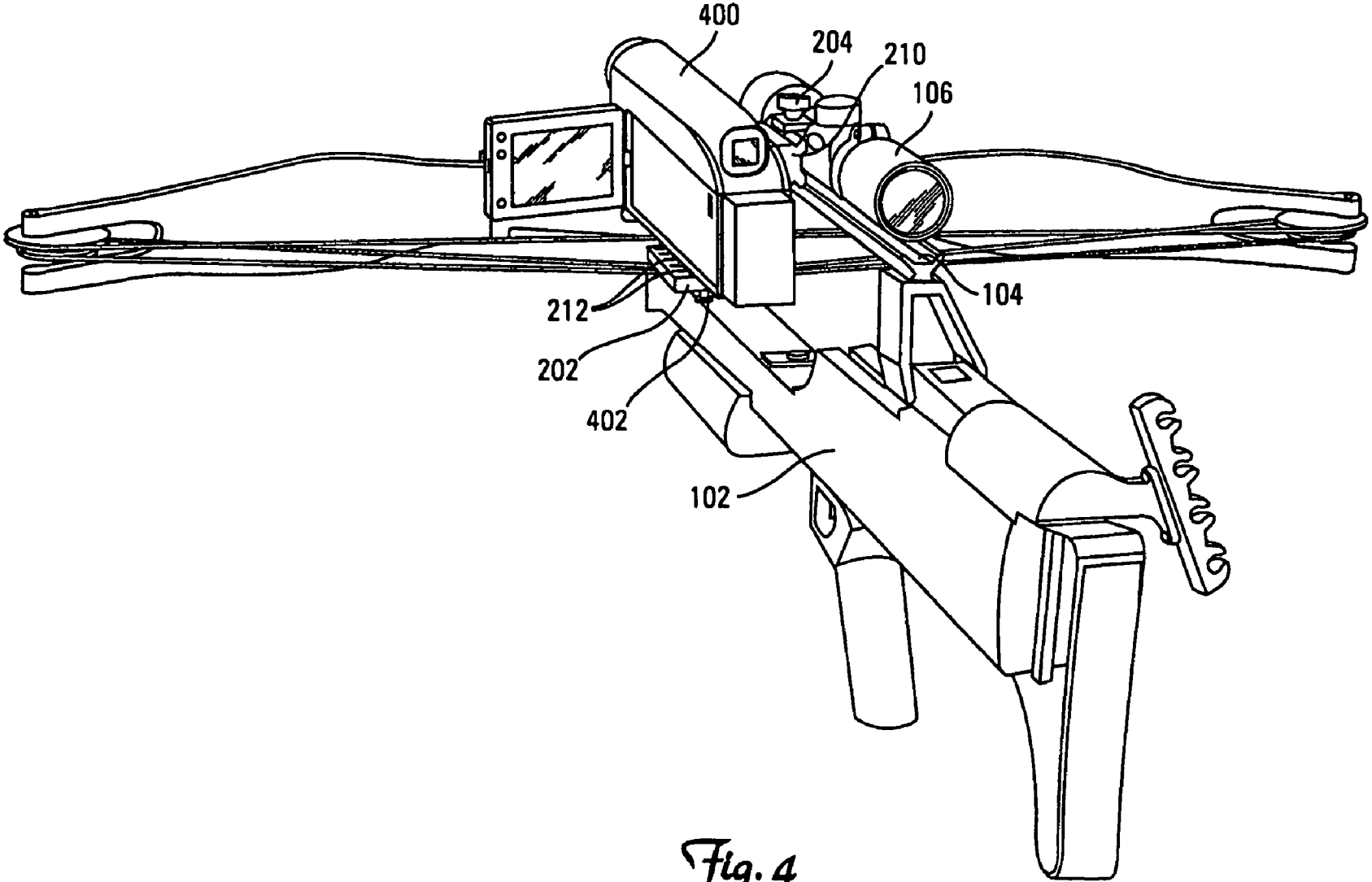
FIG. 4 is a back perspective view illustrating a device on a device mount of one embodiment of the present invention.
Figure 5:
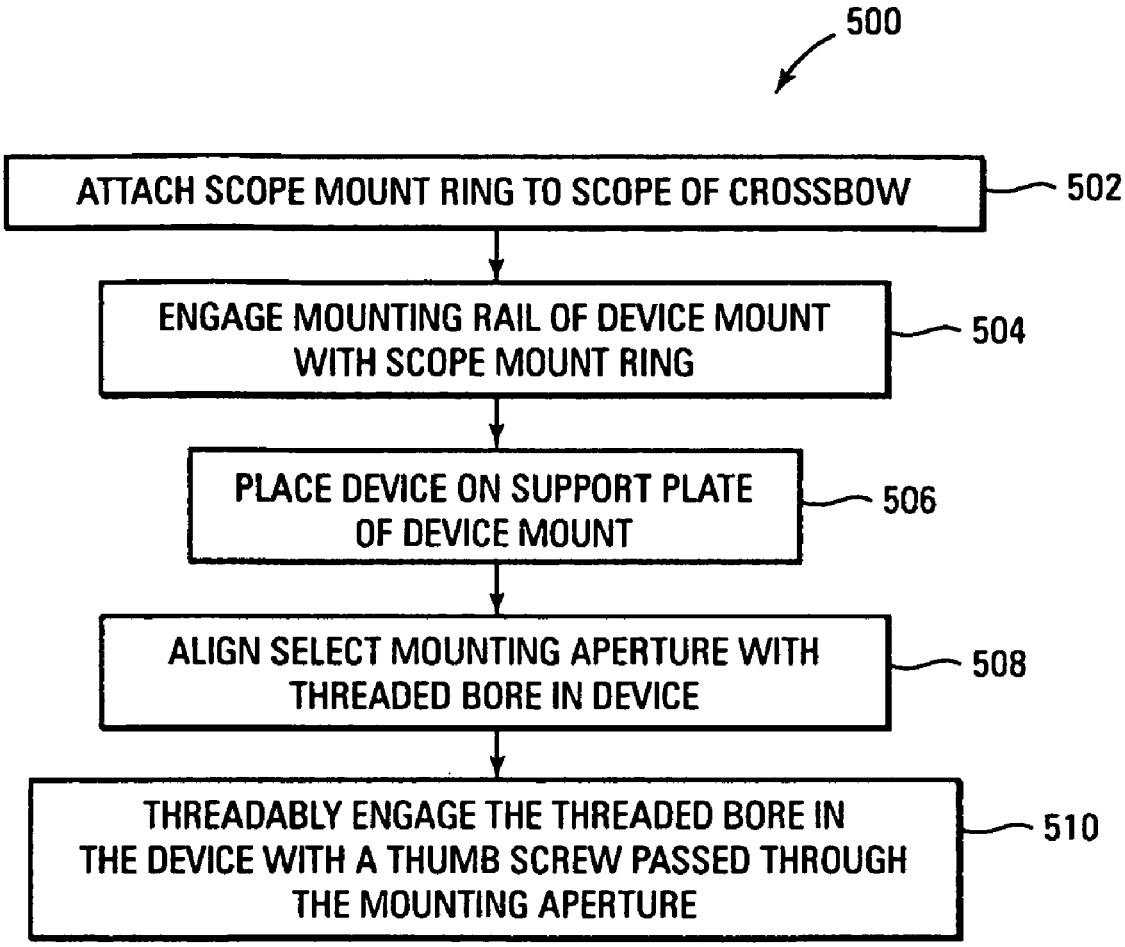
FIG. 5 is a flow diagram illustrating one method of implementing an embodiment of the present invention.

FIG. 4 is a back perspective view of the device mount 202 having a device 400 mounted thereon. In this example, the device is a video camera. However, the device may be any type of device. For example the device could be a rangefinder, a game caller or other device used when hunting. Also illustrated in FIG. 4, is a threaded attaching device 402 such as a thumb screw 402 that attaches the device 400 to the device mount 202 via a selected mount aperture 212. In FIG. 5 a flow diagram 500 illustrating one method of implementing a device mount system to a crossbow 100 is provided. As illustrated, a scope mount 204 is attached to a scope 106 of the crossbow (502). In one embodiment, this is done by positioning a circular bracket of the scope mount 204 around a body of the scope and tightening the circular bracket. A mounting rail 210 of the device mount 202 is engaged with the scope mount 204 (504) to mount the device mount 202 to the scope 106. In, particular the mounting rail 210 of the device mount 204 is received in a receiving track portion of the scope mount 204 (or scope mount ring 204) to mount the device mount 204 to the scope 106. The device 400 to be mounted is placed on a support plate 206 of the device mount (506). The device 400 is then aligned with one of the mounting apertures 212 in the support plate 206 (508). Once the threaded bore in the device 400 is aligned with a select mounting aperture 112 (508), a thumb screw is passed through the mounting aperture and threadably engaged with the threaded bore to mount the device 400 to the device mount 202 (510).

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

I claim:

1. A method of mounting an autonomous electronic device onto a crossbow, the method comprising:

(a) attaching a device mount to a scope mounted on a crossbow by (i) attaching a scope mount ring to the scope on the crossbow; and (ii) attaching the device mount to the scope mount ring such that the device mount extends from a side of the scope; and (b) securing an autonomous electronic device selected from a video camera and a range finder to the device mount such that the autonomous electronic device is positioned alongside the scope.

2. The method of claim 1, wherein attaching the scope mount ring to the scope on the cross bow further comprises positioning a circular bracket of the scope mount ring around a body of the scope and tightening the circular bracket.

3. The method of claim 1, wherein attaching the device mount to the scope mount ring further comprises positioning a mounting rail coupled to the device mount in a receiving track portion of the scope mount ring.

4. The method of claim 1, wherein:

(a) the device mount has at least one mounting aperture passing therethrough, and, (b) the autonomous electronic device is secured to the device mount by a thumb screw that extends through the at least one mounting aperture and threadably engages the autonomous electronic device.

5. A method of mounting an autonomous electronic device onto a scope mounted on a crossbow, the method comprising:

attaching a scope mount ring around the scope such that a rail receiving portion of the scope mount ring extends from a side of the scope;

engaging a mounting rail of a device mount with the rail receiving portion of the scope mount ring such that the device mount extends downwardly from the scope mount ring; and securing an autonomous electronic device to the device mount such that the autonomous electronic device is positioned alongside the scope.

6. The method of claim 5, wherein the autonomous electronic device is secured to the device mount by a thumb screw that extends through a mounting aperture located in the device mount and threadably engages the autonomous electronic device.

7. The method of claim 6, wherein the autonomous electronic device is secured to a support plate of the device mount.

8. The method of claim 7, wherein the mounting rail is located on a side plate of the device mount.

9. The method of claim 5, wherein autonomous electronic device comprises a video camera.

10. The method of claim 5, wherein autonomous electronic device comprises a range finder.

* * * * *